US012252977B2

(12) United States Patent
Dunbar et al.

(10) Patent No.: US 12,252,977 B2
(45) **Date of Patent: *Mar. 18, 2025**

(54) FORCE MEASUREMENTS ABOUT SECONDARY CONTACTING STRUCTURES

(71) Applicant: Halliburton Energy Services, Inc., Houston, TX (US)

(72) Inventors: Bradley David Dunbar, The Woodlands, TX (US); Matt Barnes, Conroe, TX (US); Brody Dunn, Conroe, TX (US); Van Jordan Brackin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/206,397

(22) Filed: Jun. 6, 2023

(65) Prior Publication Data

US 2023/0313667 A1 Oct. 5, 2023

Related U.S. Application Data

(63) Continuation of application No. 17/513,152, filed on Oct. 28, 2021, now Pat. No. 11,708,755.

(51) Int. Cl.

| | |
|---|---|
| ***E21B 10/26*** | (2006.01) |
| ***E21B 44/02*** | (2006.01) |
| ***E21B 47/013*** | (2012.01) |

(52) U.S. Cl.

CPC ..... *E21B 44/02* (2013.01); *E21B 10/26* (2013.01); *E21B 47/013* (2020.05)

(58) Field of Classification Search

CPC ..... E21B 10/26

See application file for complete search history.

(56) References Cited

U.S. PATENT DOCUMENTS

| | | | |
|---|---|---|---|
| 7,546,884 | B2 | 6/2009 | Veeningen et al. |
| 7,555,391 | B2 | 6/2009 | Gleitman |

(Continued)

OTHER PUBLICATIONS

Office Action Summary for U.S. Appl. No. 17/513,152 dated Oct. 5, 2022.

(Continued)

*Primary Examiner* — Giovanna Wright

(74) *Attorney, Agent, or Firm* — Michael Jenney; C. Tumey Law Group PLLC

(57) ABSTRACT

A drilling system, assembly, and method may help optimize drilling in a system that involves more than one rotary tool that engages the formation. A rotary tool may be a rotary cutting tool, such as a drill bit or reamer, or some other rotary tool (e.g. stabilizer or rotary steerable tool) that has the potential to drag on the wall of the hole being drilled and take energy away from cutting. In an example, a wellbore or portion thereof is formed by rotating a first rotary cutting tool having a first cutting structure in engagement with one portion of the formation together with a second rotary cutting tool having a second cutting structure in engagement with another portion of the formation. Forces are obtained above and below the second cutting structure. One or more drilling parameter or drill bit design parameter are adjusted in relation to a force differential between the forces above and below the second cutting structure.

16 Claims, 6 Drawing Sheets

(56) References Cited

U.S. PATENT DOCUMENTS

| | | | | |
|---|---|---|---|---|
| 7,962,288 | B2 | 6/2011 | Gleitman | |
| 8,364,406 | B2 | 1/2013 | Gleitman | |
| 8,407,006 | B2 | 3/2013 | Gleitman | |
| 8,875,810 | B2 | 11/2014 | Meister et al. | |
| 9,399,909 | B2 | 7/2016 | Gleitman | |
| 9,441,476 | B2 | 9/2016 | Gleitman | |
| 9,441,477 | B2 | 9/2016 | Gleitman | |
| 9,938,785 | B2 | 4/2018 | Gleitman | |
| 9,953,114 | B2 | 4/2018 | O'Donnell et al. | |
| 10,934,832 | B2 | 3/2021 | Gleitman | |
| 11,708,755 | B2 * | 7/2023 | Dunbar | E21B 47/013 175/24 |
| 2009/0078461 | A1 | 3/2009 | Mansure et al. | |
| 2012/0130693 | A1 | 5/2012 | Ertas et al. | |
| 2014/0251687 | A1 | 9/2014 | McKay | |
| 2015/0012253 | A1 | 1/2015 | O'Donnell et al. | |
| 2015/0322767 | A1 * | 11/2015 | Samuel | E21B 10/26 175/27 |
| 2018/0066513 | A1 * | 3/2018 | Sugiura | E21B 7/06 |
| 2018/0094491 | A1 | 4/2018 | Greenwood et al. | |

OTHER PUBLICATIONS

Final Office Action Summary for U.S. Appl. No. 17/513,152 dated Feb. 28, 2023.

Notice of Allowance for U.S. Appl. No. 17/513,152 dated Apr. 6, 2023.

* cited by examiner

FORCE MEASUREMENTS ABOUT SECONDARY CONTACTING STRUCTURES

CROSS-REFERENCE TO RELATED APPLICATIONS

The present application is a continuation of U.S. patent application Ser. No. 17/513,152, filed Oct. 28, 2021, the entire disclosure of which is incorporated herein by reference.

BACKGROUND

Wells are drilled in an effort to recover valuable hydrocarbons such as oil and gas. Drilling equipment must be capable of drilling deep into the earth while withstanding the tremendous forces and complex dynamic interaction between cutting tools and the formation being drilled, as well as the harsh downhole environment. Such equipment can be complex and expensive to design, build, and operate. The industry is continually seeking ways to improve reliability, efficiency, and cost involved with drilling and tool design.

BRIEF DESCRIPTION OF THE DRAWINGS

These drawings illustrate certain aspects of some of the embodiments of the present disclosure and should not be used to limit or define the method.

DETAILED DESCRIPTION

Systems and methods are disclosed for acquiring force data above and below a region of contact between a drill string and a wellbore, such as above and below a selected cutting structure in the drill string, and analyzing that force data to improve drilling and tool design. (In this context, the relative terms "above" and "below" may be equivalent to "uphole" and "downhole," respectively.) An aspect of this disclosure is a realization that having multiple rotary tools in a drill string that can contact the wellbore causes unique dynamic behavior. For example, a drill string that includes at least one reamer above the drill bit may lead to different cutting structures being at different locations in the wellbore at any given moment. In some cases, two rotary cutting tools may be tens or hundreds of feet apart. Even in an ideal, homogenous formation, the dynamic behavior of one cutting structure versus another cutting structure can be valuable to understand in terms of tool design or drilling control. In a real-world environment, as the drill string passes through different strata of a geological formation, the cutting structures of the respective rotary cutting tools may also encounter different formation properties or different wellbore geometries at any given instant. These differences may affect the efficiencies and distribution of forces and energy/power between the different cutting structures.

Various rotary tools in a drill string may contact the formation with the potential to drag on the wall of the hole being drilled and take energy away from cutting by a primary drill bit. Such other cutting structures or contacting structures may be referred to as "secondary" with respect to the cutting structure of the drill bit. As taught herein, by obtaining force measurements above and below a region of contact between the tool and the wellbore, such as above and below a selected cutting structure on a rotary cutting tool above the drill bit, it is now possible to isolate forces generated by different cutting structures. Such data may be analyzed to aid in dynamic drilling control and/or tool design. For example, by obtaining forces above and below one cutting structure (e.g., above/below a reamer), the energy required versus another rotary cutting tool (e.g., the drill bit) can be better modeled in both real-time drilling and post-drilling analysis. In some implementations, the data may be analyzed post-run in order to adjust one or more design parameters of the rotary cutting tools or the drilling assembly. In other implementations, data may be acquired and analyzed in real-time by an information handling system, so that adjustments can be automatically made by a controller while drilling.

Figure 1:
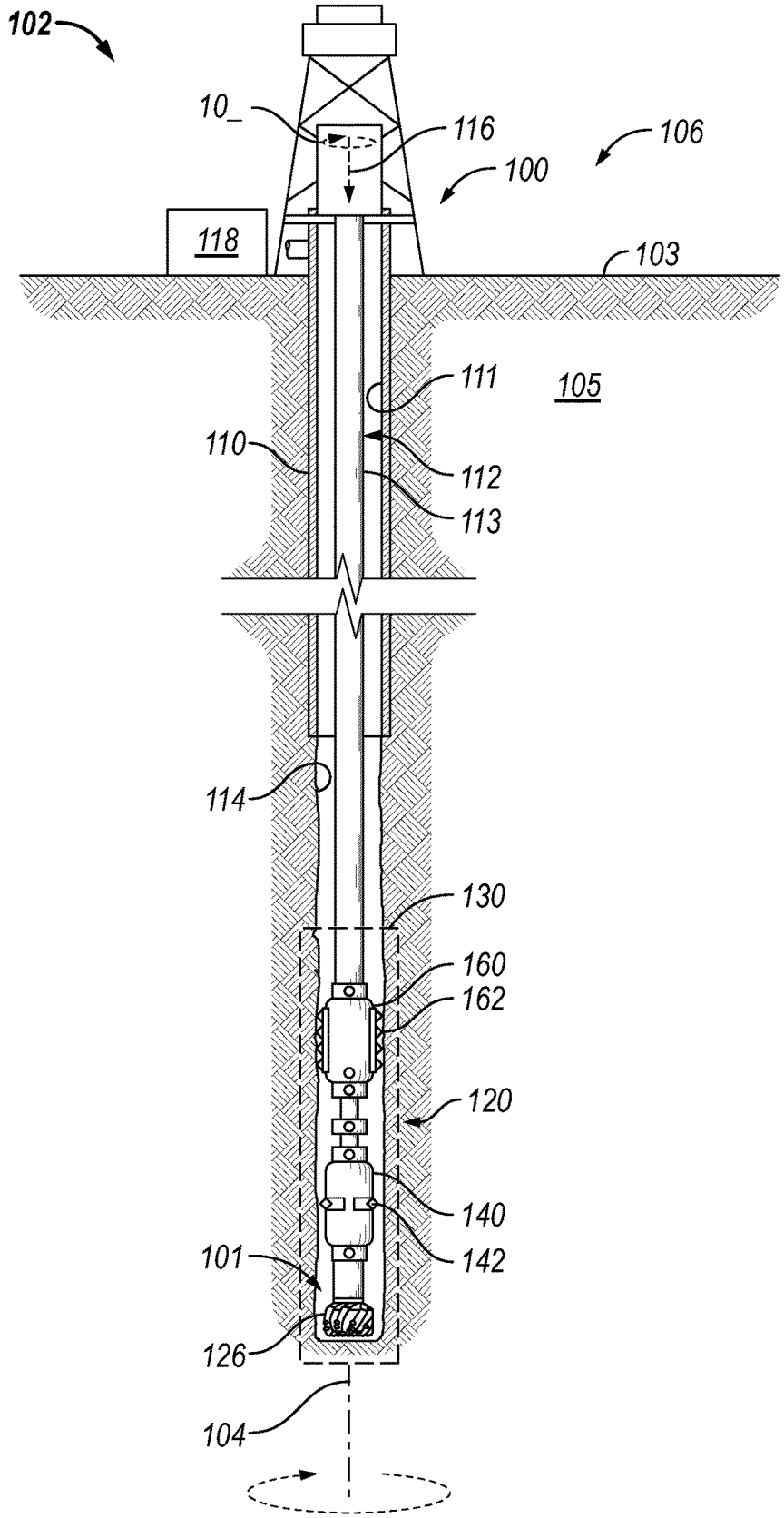
FIG. 1 is a schematic diagram of a well site at which a drilling system according to this disclosure may be implemented.

FIG. 1 is a schematic diagram of a well site 106 at which a drilling system 100 according to this disclosure may be implemented. The drilling system 100 is configured to form a wellbore 114 in an earthen formation 105 using a plurality of rotary tools. A rotary tool according to this disclosure may be any tool having a structure that contacts the wellbore 114, i.e., a contacting structure, with the potential to drag on the wall of the hole being drilled and take energy away from cutting. A rotary tool may specifically be a rotary cutting tool, such as a drill bit or reamer, wherein the contacting structure comprises a cutting structure as further described below. Other rotary tools, such as a stabilizer or steerable tool, do not have cutting structures expressly configured for cutting, but which may still contact the wellbore 114 and take energy away from cutting by the drill bit or other rotary cutting tool. By way of example, three rotary cutting tools are included in this embodiments, depicted as a drill bit 101, a lower reamer 140, and an upper reamer 160. However, aspects of the disclosure may be applied to any drilling system having two or more rotary tools of any type that may be used in combination for forming the wellbore 114 or portion thereof in the earthen formation 105.

Various surface equipment is included at a surface 103 of the well site 106 to support drilling. A drilling rig 102 is depicted here as a land drilling rig, although aspects of the disclosure may also be used with offshore platforms, drill ships, semi-submersibles and drilling barges. The drilling rig 102 includes a large support structure (e.g., derrick and/or mast) that supports a drill string 112 as it extends below the surface 103 while drilling. Surface equipment (not all shown) may include a hoist for raising and lowering the drill string 112, tubing handling equipment, such as tongs, for making up or breaking out drill string connections, a rotary table and a motor 116 for driving rotation of the drill string 112, and fluid circulation equipment such as pumps and tanks for circulating drilling fluid (mud) downhole while drilling. While drilling, a drilling fluid may be pumped through the drill string 112, through respective nozzles in the drill bit 101, and back to surface 103. Portions of the wellbore 114 may then be reinforced with a casing 110. Portions of the wellbore 114 not reinforced with the casing 110 may be described as "open hole."

The drill string 112 includes a long, tubular conveyance 113 suspended from the drilling rig 102 with a bottom hole assembly (BHA) 120 supported thereon. The tubular conveyance 113 extends into the wellbore 114 as it is formed during drilling. The conveyance 113 may be assembled at the surface 103 by progressively adding tubular segments (e.g., drill pipe) to reach a desired wellbore depth. In other drilling scenarios, the tubular conveyance 113 could comprise another type of tubular conveyance, such as coiled tubing. The conveyance 113 supports the weight of the BHA 120 and may transfer torque to the drill bit 101, lower reamer 140, and upper reamer 160. The tubular conveyance provides fluid communication downhole, such as for circulation of the drilling fluid. The tubular conveyance 113 may also support signal communication (e.g., fluid pulse, electrical, or wireless) between components of the BHA 120 and/or between the BHA 120 and a controller 118 optionally located at surface 103.

The BHA 120 is a portion of the drill string 112 that includes a variety of downhole tools and other components to support drilling. A subassembly of the BHA 120 includes the drill bit 101, lower reamer 140, and upper reamer 160 is referred to herein as the drilling assembly 130. The rotary drill bit 101 is at the bottom (leading end) of the drill string with the two reamers 140, 160 positioned above (uphole of) the drill bit 101 to further widen, shape, or otherwise form a portion of the wellbore 114. The drill bit 101, lower reamer 140, upper reamer 160, or other combination of rotary cutting tools may be individually coupled, directly or indirectly within the BHA 120, and may rotate together. The rotary cutting tools may be axially spaced apart on the drill string 112 with any given spacing therebetween. Other examples of BHA components that may be included are drill collars, directional drilling tools, downhole drilling motors, stabilizers, subs, and an electronics package.

Generally, each rotary cutting tool includes a contacting structure that comprises a cutting structure for engaging the earthen formation 105 to cut or otherwise remove or disintegrate the earthen material. For example, a contacting structure of the drill bit 101 may include a cutting structure comprising a plurality of fixed cutters (not expressly shown) secured to blades 126 on a bit body. The contacting structure of the drill bit 101 could include other elements that are not expressly configured for cutting, such as wear-resistant elements (not expressly shown). Alternatively, a drill bit could include any other suitable cutting structures such as rolling cutters, roller cones, diamond-impregnated cutters, rolling cutting structures, other types of fixed cutters, or hybrids of the foregoing. The reamers 140, 160 also include respective cutting structures schematically indicated at 142 and 162, respectively. The cutting structures 142, 162 on the reamers 140, 160 may be provided on reamer arms, pistons, or other members that are extendable toward and retractable away from a wellbore. For example, the reamer may be tripped into a well with the reamer arms, pistons, or other members retracted and then selectively extended when it is desired to engage the formation. This may be referred to as radially extendable and retractable (not necessarily a pure radial movement), in that the movement inward or outward comprises a radial component of movement to reach or move away from the wellbore.

In another embodiment, one or both of the rotary tools 140, 160 could be configured as non-cutting rotary tools, in which case the respective cutting structure(s) 142, 162 could be substituted with contacting structures that contact the formation to generate drag, but are not expressly configured to cut. For example, such other contacting structures might have no cutting edge, and/or be formed from a softer, relatively non-abrasive material. Examples of such other non-cutting tools may comprise, for example, a bent motor housing, a rotary steerable tool body excluding any cutting structures that might be included elsewhere on a steerable tool, or a stabilizer or centralizer, as non-limiting examples. In such other embodiments, sensors may be positioned above and below the (non-cutting) contacting structures.

The rotary cutting tools may be rotated together while drilling, such as by rotation of the entire drill string 112 from surface or via a downhole motor (not shown) included with the BHA 120. The drill bit 101 leads the other two rotary cutting tools 140, 160 while drilling and is used to form the initial wellbore 114. The other rotary cutting tools 140, 160 trail the drill bit 101 and may be used to further cut the formation 105 in forming the wellbore 114. Thus, at any given point in drilling, one or more of the rotary cutting tools 101, 140, 160 may engage different regions of a formation having different properties, dimensions, and/or orientations. All of the cutting structures will experience forces while in contact with the wellbore 114, which contributes to the load and energy/power consumption. The cutting structures of all three rotary cutting tools need not be in continuous contact with the formation. For example, while initially forming the wellbore 114 the cutting structures on the reamers 140, 160 may be retracted, and later selectively extended to form portions of the wellbore 114. However, in certain drilling steps at least two of the rotary cutting tools may be engaging the formation simultaneously. Therefore, the drilling system 100 is configured to identify different forces or force differentials about the cutting structures of the different rotary cutting tools.

The BHA 120 includes one or more elements of an electronic package. The electronic package may include various sensors for acquiring downhole data elements such as an accelerometer, a gyroscope, a magnetometer a memory medium, and a central processing unit (CPU). Sensors in the electronic package may be used to monitor and analyze downhole forces at various locations along the BHA. The sensors include various strain gauges at different locations in the BHA 120 to acquire strain data, from which forces may be obtained. The various strain gauges may be positioned to acquire force data above and below the cutting structure of each of the respective rotary cutting tools. By acquiring force measurements above and below a particular cutting structure, it is possible to isolate forces generated by that cutting structure, which may be analyzed to improve drilling, such as to optimize cutting tool design and/or drilling parameters.

The data acquired from the various sensors may be stored and/or transmitted to an information handling system located above and/or below the surface 103 of the well site 106. For example, the information handling system may be included with or in communication with a controller 118 that controls downhole drilling parameters. The acquired data may be used in some embodiments to dynamically adjust drilling parameters in real-time (i.e., while drilling), such as a rotation 105 controlled by a motor 116 or the weight on bit (WOB) applied to the drill string 112. Alternatively the acquired data may be used to adjust a design of the rotary cutting tools or their placement within the BHA 120 for future drilling operations.

Figure 2:
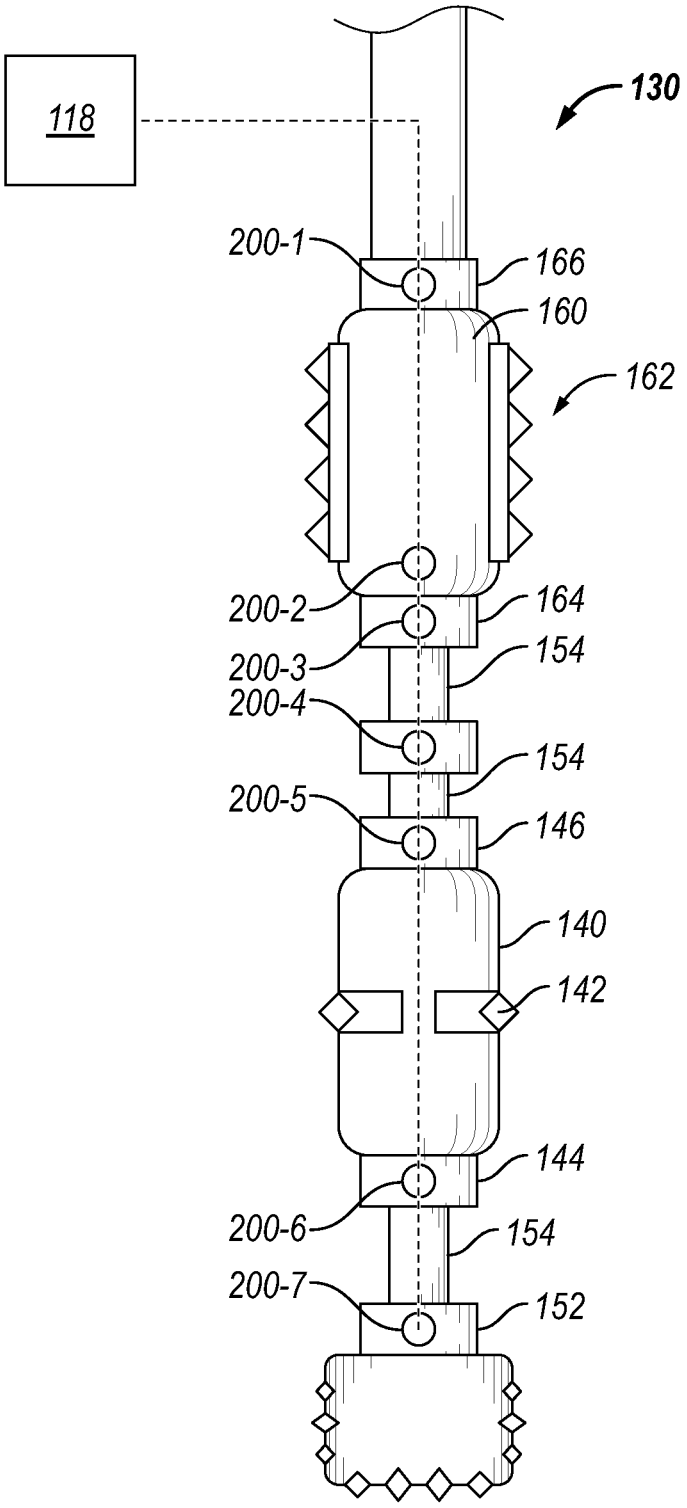
FIG. 2 is a schematic diagram of the drilling assembly of FIG. 1, further detailing connections between the rotary tools and the relative positioning of strain gauges.

FIG. 2 is a schematic diagram of the drilling assembly 130 of FIG. 1, further detailing connections between the rotary tools and the relative positioning of strain gauges 200. As an example of how the illustrated drilling assembly configuration could be used, the wellbore 114 may be partially formed with the drill bit 101, such as drilling to a certain depth. The arms of the upper reamer 160 may then be extended and the upper reamer 160 rotated to widen a portion of the wellbore 114, leaving an initial unenlarged portion (i.e., "rathole") between the upper reamer 160 and the drill bit at the total depth ("TD") of the wellbore. Then, the cutting structure 142 of the lower reamer 140 can be extended and used to enlarge the initial rathole. The lower reamer 140, by virtue of its positioning close to the drill bit 101 (e.g., a near-bit reamer), thus effectively shortens the rathole according to a spacing between the lower reamer 140 and the drill bit 101.

The forces experienced by the two or more cutting tools may contribute to the total load, efficiency splits, and so forth of the drilling assembly 130. In this or other drilling operations, one or more of the cutting tools (i.e., the drill bit 101, lower reamer 140, and/or upper reamer 160) may contact the wellbore at any given moment or throughout any given drilling step. In some cases, only one cutting tool may be cutting, such as when drilling an initial wellbore with all reamer cutting structures retracted. In other cases, at least two cutting tools may be intentionally engaged with the wellbore simultaneously for cutting, such as when drilling while reaming. In still other cases, it may be possible for two or more cutting tools to contact the formation whether intentionally or unintentionally. It is useful according to this disclosure to therefore obtain force measurements above and below the cutting structure of one cutting tool so as to identify forces associated with a particular cutting structure as compared with forces that may be experienced by other cutting structures or other features of the drilling assembly.

The rotary cutting tools may be directly or indirectly coupled to each other within the drilling assembly 130. The spacing between the rotary cutting tools may vary depending on the configuration. For example, in one example, the lower reamer 140 may be a near-bit reamer positioned only a few feet away from the drill bit 101, and the upper reamer 160 may be positioned tens or hundreds of feet above the drill bit 101. The physical connections between the rotary cutting tools may be made in any of a variety of suitable connection types, such as using a combination of different subs and/or tubing sections. Thus, the rotary cutting tools may be individually selected for a given job, along with an appropriate spacing and connection therebetween. In this example, the drill bit 101 has a shank 154 for coupling to a component of the drilling assembly above it. The lower reamer 140 has a bottom sub 144 for connecting to components below it and a top sub 146 for connecting to components above it. The upper reamer 160 likewise has a bottom sub 164 and a top sub 166. The drill bit 101, lower reamer 140, and upper reamer 160 may be connected using their respective subs, such as to intermediate tubing sections 154, separate subs 155, or other drilling assembly components.

A plurality of strain gauges 200 are located within the drilling assembly 130, and are positioned to obtain measurements above or below selected cutting structures. Non-limiting example locations for the strain gauges 200 shown in FIG. 2 include in a body of the respective cutting tool (e.g., 200-2), in a top or bottom sub of the respective cutting tool (e.g., 200-1, 200-3, 200-5, 200-6), or in separate subs (e.g., 200-4).

Different pairs of strain gauges 200 at different locations may be selected (e.g., manually or by a controller) to obtain the forces above and below a particular cutting structure, and to obtain a force differential therebetween. A pair of strain gauges used to obtain a force differential above and below a given cutting structure may be, but are not required to be, the strain gauges that are nearest to that cutting structure. For instance, any of strain gauge pairs {200-1, 200-2}, {200-1, 200-3} or {200-1, 200-4} may be used to obtain a force differential about the cutting structure 162 of the upper reamer 160. Likewise, any of strain gauge pairs {200-3, 200-6}, {200-4, 200-6}, or {200-5, 200-6} could be used to obtain a force differential about the cutting structure 142 of the lower reamer 140. By identifying forces above and below a given cutting structure and the force differential therebetween, it is possible to isolate the contribution to force, energy, power, efficiency, and other parameters contributed by that particular cutting structure from the contribution of other cutting structures.

It may be desirable in some cases to select the strain gauges closest to the cutting structure about which a force differential is to be obtained. However, at least in some cases, the strain gauges are not required to be the nearest strain gauges to a cutting structure, and might not even be required to be adjacent to the respective cutting structure. For example, in a drilling step where the drill bit 101 and lower reamer 140 are both engaging a formation but the reamers arms of the upper reamer 160 are retracted, it may be possible to infer the forces on the lower reamer cutting structure 142 by using the strain gauge 200-1 above the upper reamer in combination with the strain gauge 200-6 or even the strain gauge 200-7 on the shank 152 of the drill bit (which is above the cutting structure of the drill bit 101). A controller 118 in communication with the strain gauges 200 and/or other electronics associated with the rotary cutting tools may be configured to select which pair(s) of strain gauges 200 to use at any given moment, such as depending on which cutting structures are currently engaging a formation.

Strain gauges may be positioned throughout the drilling assembly 130 and secured thereto in any suitable manner. The following figures illustrate just some example configurations in which strain gauges are incorporated into strain pucks mounted to various tool bodies or components thereof.

Figure 3:
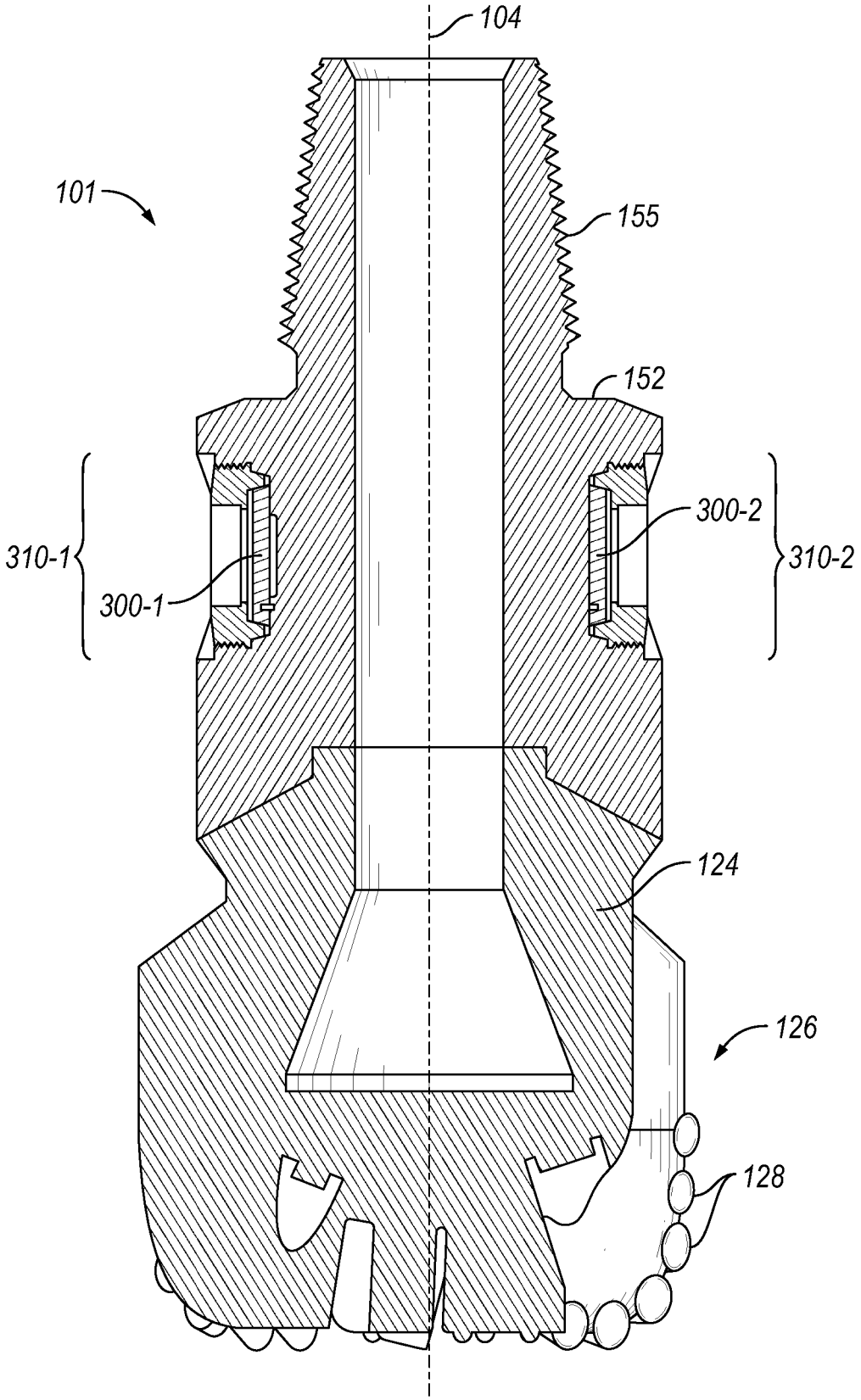
FIG. 3 is a cross-sectional view of the drill bit according to an example configuration wherein strain gauges are incorporated into strain pucks coupled to the drill bit.

FIG. 3 is a cross-sectional view of the drill bit 101 according to an example configuration wherein strain gauges are incorporated into strain pucks 300 coupled to the drill bit 101. Any number of strain pucks may be included at a variety of spacings. In the example of FIG. 3, the two strain pucks 300-1 and 300-2 are coupled to the drill bit 101 within recessed areas 310-1 and 310-2 defined in the shank 152. The strain pucks 300-1, 300-2 are optionally circumferentially spaced 180 degrees from one another. In an alternative embodiments, a drill bit may include, for example, three strain pucks disposed 120 degrees from one another or four strain pucks disposed 90 degrees from one another.

The drill bit 101 may have any of a variety of different designs, configurations, and/or dimensions according to the particular application of drill bit 101. Although a fixed-cutter drill bit is depicted, these principles may be applied, using the description provided herein, by one of ordinary skill in the art to other types of downhole drilling tools that cut into a formation, such as roller cone drill bits, coring bits, and/or reamers. The shank 152 has a connector, embodied here as drill pipe threads 155, to connect the drill bit 101 with a BHA. The drill bit 101 is rotatable about a central bit axis 104 defined by the drill bit 101 and its connection with the drill string. One or more blades 126 are disposed outwardly from exterior portions of rotary bit body 124. The cutting structure of the drill bit 101 comprises a plurality of cutters 128 disposed on the blades 126. The cutting structure cuts the formation when the drill bit 101 is rotated about the bit axis 104 while the cutters 128 are engaging the formation. The cutters 128 may be any suitable device configured to cut into a formation, including but not limited to polycrystalline diamond compact (PDC) cutters, buttons, inserts, and abrasive cutters. Cutting the formation in this context encompasses any of cutting, shearing, gouging, scraping, disintegrating, or otherwise removing material of the formation by direct contact between the cutters or other cutting structure and the formation.

In each of these examples, data received from the strain gauges disposed on the strain puck(s) 300 may be used simultaneously for analysis to determine downhole forces being applied to shank 152, for example, to identify a direction of a bending force and/or to determine whether a torsional force is symmetric around shank 152. Each strain puck 300 includes one or more strain gauge, such as the strain gauges 200 of FIG. 2. The strain gauges disposed on each strain puck 300 may collect data indicating downhole forces applied to drill bit 101 during a drilling process. In particular, downhole forces applied to shank 152 of drill bit 101 may be similarly applied to each strain puck 300 and, in turn, to the strain gauges disposed thereon. Each strain puck 300 may transmit data indicating downhole forces to one or more receivers such that the data from each strain gauge may be analyzed. Specifically, strain gauges on each strain puck 300 may collect data indicating compression forces, bending forces, and torsional forces applied to each strain puck 300 during a drilling operation and may transmit the collected data in real-time. This data may be received by a receiver for real-time analysis or stored in a memory medium within drill bit 101 for analysis at a later time.

Any suitable sensor may for obtaining force measurements is considered within the scope of this disclosure. A strain gauge is one preferred way to collect data indicating a downhole force applied to a rotary cutting tool. Strain provides an indication of force on a body, such as bending, compression, tension, or torque, so a strain gauge may be oriented to register strain related to a particular one or more of these types of forces. Other data that may be derived from force data includes power data and efficiency data, for example. The force data acquired by sensors may be analyzed to identify downhole parameters such as efficiency splits or energy (power) consumption/loss attributable to these forces. Although the strain pucks 300 are axially spaced from the cutting structure of the drill bit 101, the forces at the cutting structure can be inferred from the strain response detected at the shank 152. In one example, data indicating compression forces applied to both strain pucks 300-1 and 300-2 may be analyzed to calculate the weight on bit (WOB) based on a compression value from strain puck 300-1 and a compression value from strain puck 300-2. In another example, a bending value may be calculated based on a compression value from one strain puck 300-1 and a tension value (i.e., indicating a tensile force) from the other strain puck 300-2. In yet another example, a torque on bit (TOB) value may be calculated based on torsion value (i.e., indicating a torsional force) applied to both strain pucks 300-1 and 300-2.

Figure 4:
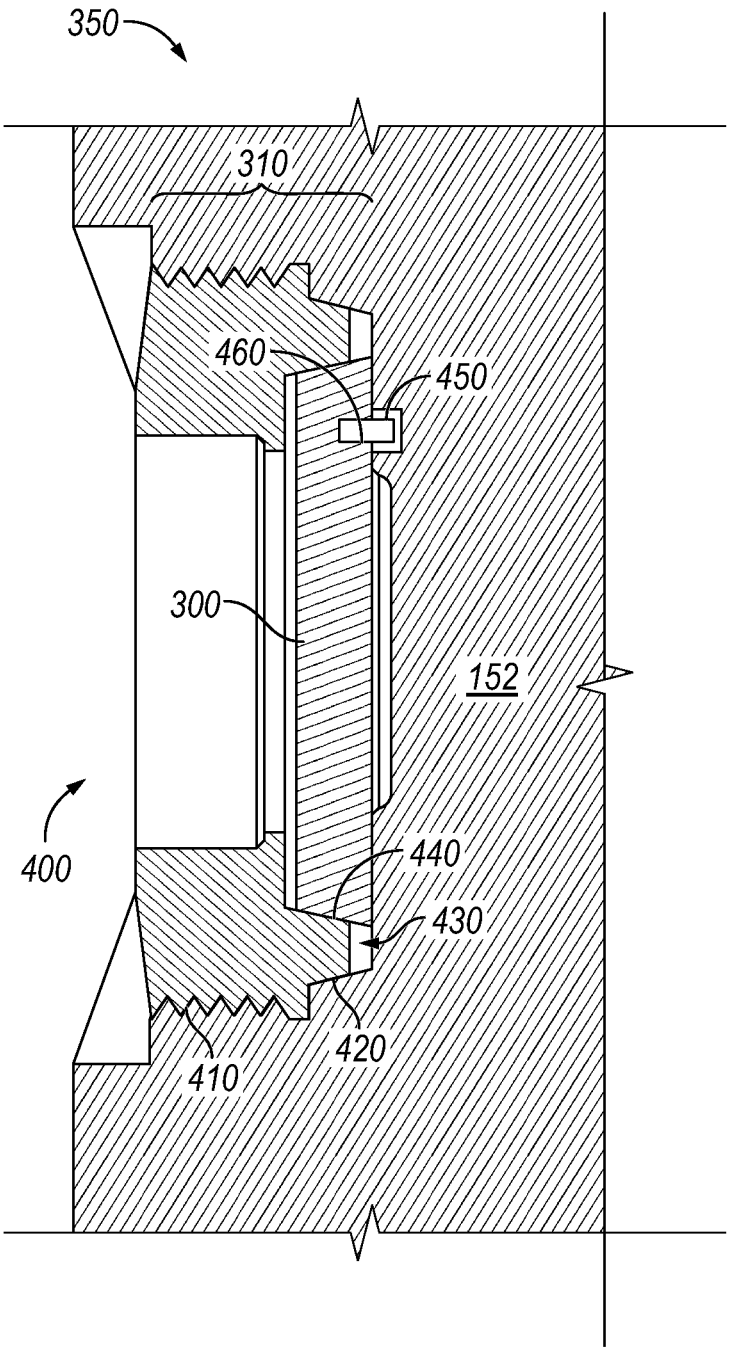
FIG. 4 is a cross-sectional view of a strain puck in a generalized tool body of a rotary cutting tool, such as a reamer, another drill bit, or a sub of the drilling assembly.

FIG. 4 is a cross-sectional view of a generalized tool body 350 providing example of how a strain puck 300 may be coupled to another rotary cutting tool, such as a reamer, another drill bit, or a sub of the drilling assembly. A puck wedge 400 is provided to secure the strain puck 300 to the tool body 350. The puck wedge 400 may include a chamfered point 430 positioned below threads 410. The chamfered point 430 may be contoured to form a wedge between a chamfered edge 440 of strain puck 300 and a chamfered portion 420 of surrounding recessed area 310 within shank 152. Because chamfered point 430 applies a radially inward tightening force upon the chamfered edge 440 of the strain puck 300, the tightening force may be evenly distributed around the circumference of the strain puck 300. This ensures that downhole forces applied to the shank 152 may be similarly applied to the strain puck 300 and, in turn, to strain gauges disposed thereon.

As further illustrated in FIG. 4, an alignment pin 450 may be placed within an alignment pin slot 460 of the strain puck 300. The alignment pin 450 may be used to ensure that strain puck 300 and the strain gauges disposed thereon are properly aligned within recessed area 310. In particular, the alignment pin 450 may be used to couple the alignment slot 460 of the strain puck 300 with a slotted portion of a surrounding recessed area 310. Coupling the alignment slot 460 with a slotted portion of surrounding recessed area 310 of shank 152 may ensure that each strain gauge disposed on the strain puck 300 is properly aligned with the downhole force, or downhole forces, in which the strain gauge is configured to measure.

Figure 5:
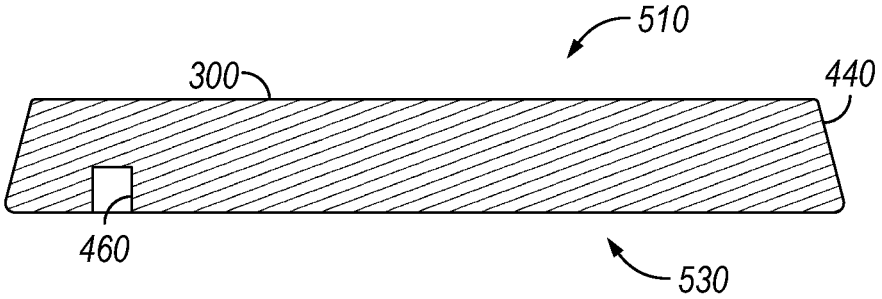
FIG. 5 is a side view of the strain puck according to an example configuration.

FIG. 5 is a side view of a strain puck 300 according to an example configuration. The strain puck 300 may be positioned within a downhole drilling tool (e.g., such as drill 101 bit of FIG. 3, generalized tool body 350 of FIG. 4, or elsewhere within a drilling assembly, such that downhole forces applied to the drilling assembly during a drilling operation may similarly be applied to strain puck 300. The strain puck 300 includes a strain puck surface 510 on which strain gauges (not expressly shown) are disposed. The strain puck 300 may be coupled to a downhole drilling tool in a threaded manner, for example, allowing the strain puck 300 to be removed and reattached from the downhole drilling tool without damaging or destroying the strain gauges. For example, the strain puck 300 may be easily removed when the downhole drilling tool is removed from the wellbore, for example, during repair, cleaning, or any other suitable maintenance.

In the example illustrated in FIG. 5, the strain puck 300 includes the alignment pin slot 460. As in FIG. 4, the alignment pin slot 460 in FIG. 5 may be configured to receive the alignment pin 450 to ensure that the strain puck 300 is properly aligned with the rotary cutting tool or other drilling assembly component. Proper alignment of the strain puck 300 may ensure that strain gauges disposed on the strain puck surface 510 collect accurate measurements of the downhole forces applied to the downhole drilling tool during a drilling operation. In particular, the alignment pin slot 460 may ensure that each strain gauge disposed on the strain puck surface 510 is properly aligned, or calibrated, with the downhole force(s) that the strain gauges are configured to measure. More specifically, each strain gauge may be calibrated to collect measurements of a downhole force without receiving tangential interference from one or more surrounding downhole forces. For example, a strain gauge disposed on the strain puck surface 510 to measure compression forces may be oriented vertically along rotational axis 104 shown in FIG. 3 such that compression forces applied to the downhole drilling tool along rotational axis 104 may be accurately measured without receiving interference from torsional forces. In addition, strain gauges may be calibrated on the strain puck surface 510 of the strain puck 300 prior to the strain puck 300 being coupled to a downhole drilling tool. In particular, compression and/or torsional forces may be applied to strain gauges such that a response (e.g., a change in electrical resistance) from each strain gauge may indicate whether the strain gauge is calibrated in a proper alignment with the compression and/or torsional forces. Strain gauges may retain calibration upon being coupled to the downhole drilling tool by properly aligning the strain puck 300 using the alignment pin slot 460.

In the example illustrated in FIG. 5, the strain puck 300 may include two circular surfaces of different circumferences creating chamfered edge 440 along the side of strain puck 300. Strain puck surface 510 may have a smaller circumference than the strain puck base 530 to form a truncated cone. As shown in FIG. 4, the chamfered edge 440 along the side of strain puck 300 may receive a chamfered point 430 of the puck wedge 400 used to removably couple the strain puck 300 to the shank 152 such that downhole forces applied to the shank 152 during a drilling operation may be similarly applied to the strain puck 300 and, in turn, the strain gauges disposed thereon. In another example (not expressly shown), strain puck surface 510 may have a larger circumference than strain puck base 330 to form an inverted truncated cone. In this example, the inverted truncated cone may have a chamfered edge 440 along the side of the strain puck 300 that may be received by a chamfered portion of a downhole drilling tool (e.g., a chamfered portion of a recessed area of shank 152) such that the strain puck 300 may be coupled to the downhole drilling tool along the chamfered edge 440.

Figure 6:
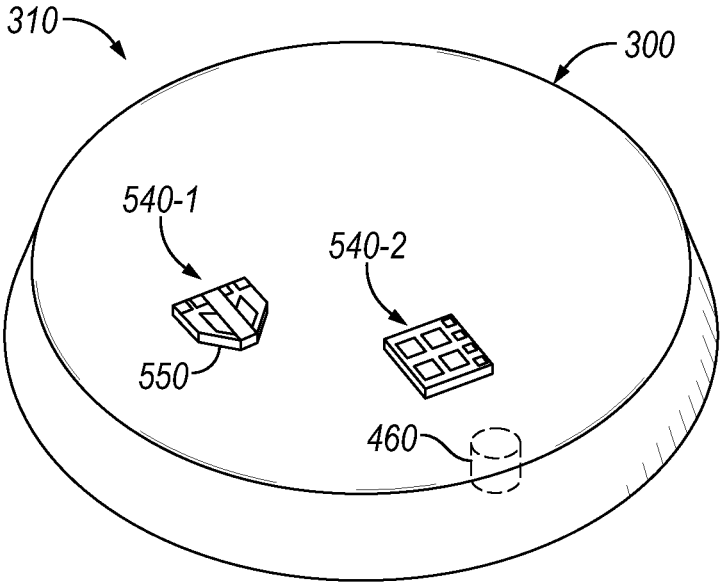
FIG. 6 is an isometric view of the strain puck with an example positioning of the strain gauges.

FIG. 6 is an isometric view of the strain puck 300 that includes example positioning of the strain gauges. In the example illustrated in FIG. 6, the strain puck 300 includes strain gauges 540-1 and 540-2 (collectively referred to herein as "strain gauges 540") disposed on strain gauge surface 510 for collecting data indicating downhole forces applied to a downhole drilling tool (e.g., drill bit 101 and/or subassemblies 122 illustrated in FIG. 1) during a drilling operation. More specifically, downhole forces applied to the downhole drilling tool may be similarly applied to strain puck 300 and, in turn, to strain gauges 540 disposed thereon. Strain gauges 540 may be disposed upon strain puck surface 510 such that the orientation of each strain gauge 540 in relation to the downhole drilling tool is properly aligned with the downhole force(s) applied to the downhole drilling tool. In particular, the orientation of each strain gauge 540 may be aligned with a downhole force in relation to alignment slot 460.

In the example illustrated in FIG. 6, strain gauge 540-1 measures torsional forces and strain gauge 540-2 measures compression and bending forces. In particular, strain gauge 540-1 may be a torsional strain gauge disposed on strain puck surface 510 such that edge 550 of strain gauge 540-1 is oriented at a forty-five degree angle in relation to a tangent of strain puck surface 510. The tangent of the strain puck surface 510 may be perpendicular to the radius of the strain puck surface 510 at a point of tangency at the alignment slot 460. Given the orientation of strain gauge 540-1 in relation to the alignment slot 460, the strain gauge 540-1 may be calibrated on the strain puck surface 510 to measure torsional forces applied to drill bit 101. Strain gauge 540-2 may be an axial strain gauge disposed on the strain puck surface 510 such that the strain gauge 540-2 is oriented vertically in relation to the alignment slot 460 (i.e., along rotational axis 104 shown in FIG. 2). Given the orientation of the strain gauge 540-2 in relation to the alignment slot 460, the strain gauge 540-2 may be calibrated on the strain puck surface 510 to measure compression and tensile forces applied to a downhole drilling tool. Therefore, each strain gauge 540 may measure a different downhole force based on an orientation at which the strain gauge 540 is disposed in relation to alignment slot 460 of strain puck 300.

In one example, the strain gauges 540 may be equipped with wireless transmitters such that signals received by strain gauges 540 (i.e., downhole forces applied to strain puck 300) may be conveyed to a wireless receiver. More specifically, each strain gauge 540 may include a wireless transmitter that allows the strain gauge 540 to transmit data indicating downhole forces during a drilling operation to a wireless receiver in real-time. For example, each strain gauge 540 disposed on a downhole drilling tool may be equipped with an antenna that allows the strain gauge 540 to wirelessly transmit data indicating compression forces to a wireless receiver. In another example, each strain gauge 540 may include a transmitter wired to a receiver that allows the strain gauge 540 to transmit data indicating downhole forces during a drilling operation in real-time.

Data received from strain gauges disposed on each strain puck 300 may be used, together with strain data from elsewhere in the drilling assembly for analysis. Analysis of data received from strain gauges, and particularly, the force differentials about the different cutting structures of the multiple rotary cutting tools, may suggest ways in which one or more downhole drilling parameters and/or one or more design parameters may be modified as further described below. Examples of the downhole drilling parameters may include rotational speed of the drill bit in revolutions per minute (RPM), a rate of penetration (ROP), a weight on bit (WOB), a torque on bit (TOB), and a depth-of-cut control (DOCC). The rate of penetration (ROP) of drill bit 101 may be a function of both weight on bit (WOB) and revolutions per minute (RPM).

Figure 7:
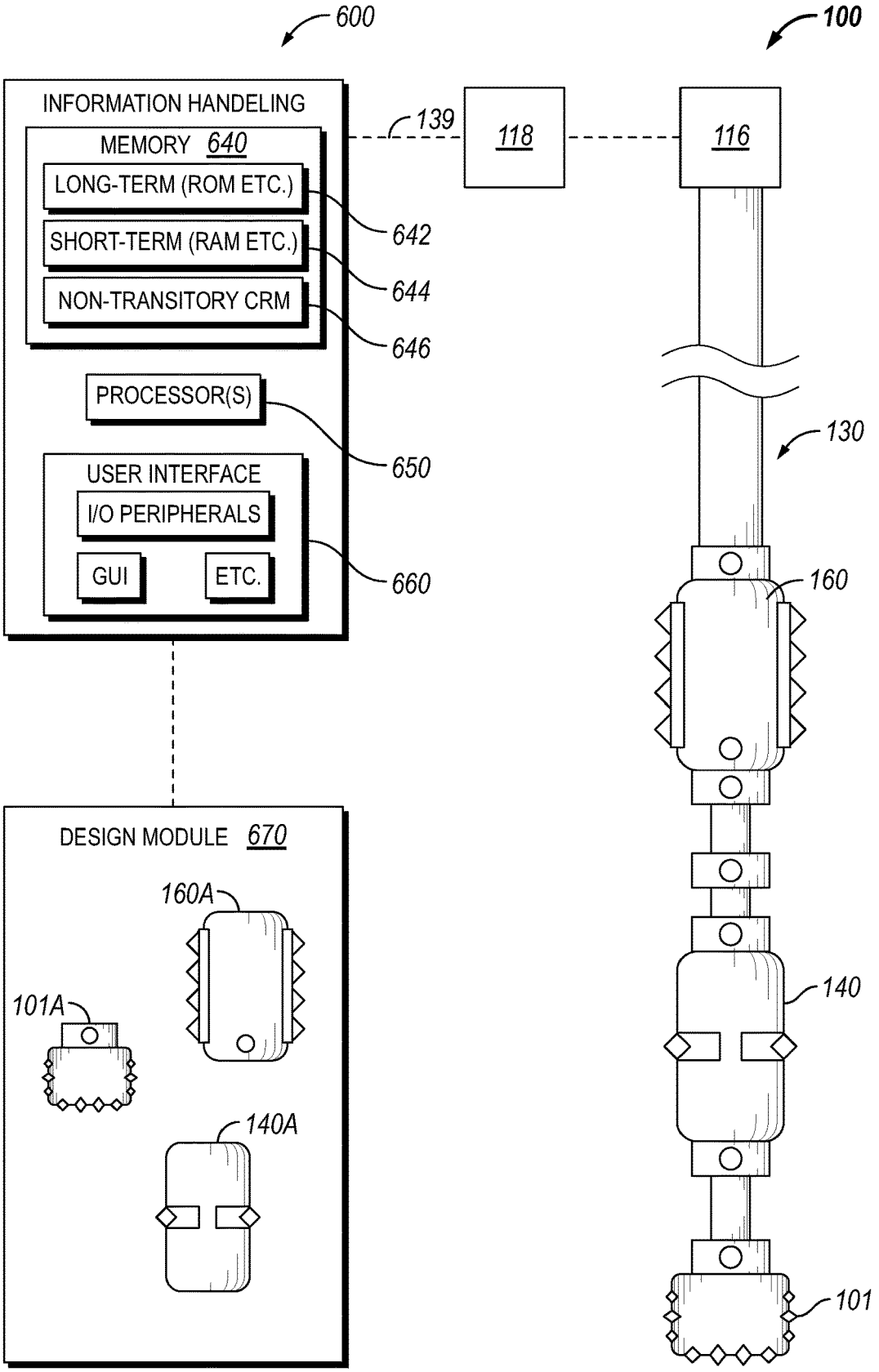
FIG. 7 is a schematic diagram of the drilling system as configured to optimize drilling in relation to force measurements in the drilling assembly.

FIG. 7 is a schematic diagram of the drilling system 100 as configured to optimize drilling in relation to force measurements in the drilling assembly 130. An information handling system 600 is provided to receive, process, and/or analyze strain and force data to optimize drilling. In one or more examples, the information handling system 600 is in communication with the controller 118, motor 116, and/or other components of the drilling assembly 130 to optimize drilling of the present well. In one or more other examples, the information handling system 600 includes, or is in communication with, a design module 670 used to optimize drilling of future wells by adjusting the design of rotary cutting tools or other aspects of the drilling assembly 130.

As used herein, the term optimization does not mean that an optimal set of parameters or conditions is necessarily achieved. Rather optimization may include adjusting one or more relevant parameters in relation to measured forces in an effort to at least improve some aspect of drilling. An example of optimization related to tool design may entail improving cutter placement on one or more rotary cutting tools, such as to improve a distribution of forces or efficiency split among the rotary cutting tools. An example of optimization related to dynamic drilling assembly control may entail adjusting one or more controllable drilling parameters (e.g., WOB, TOB, RPM, etc.) to improve performance parameters such as force distribution, energy distribution, and efficiency splits.

The information handling system 600 may be in direct or indirect communication with the BHA 120 (see, e.g., FIG. 1) that includes the drilling assembly 130. The information handling system 600 may also be in direct or indirect communication with the design module 670. The information handling system 600 may be used to gather, store, process, communicate, and/or analyze the data from the sensors and other inputs and optionally coupled with the controller 118 and/or motor 116 to control operation of the drilling assembly 130 or other BHA components. The information handling system 600 may include various spatially separated components, which may include various above-ground components (e.g. at a surface of the wellsite and/or a remote location) and/or below-ground components. Such distributed or spatially separated components may be connected over a network or other suitable electronic communication medium. Thus, processing, storing, and/or analyzing of information may occur at different locations and times, and may occur partially downhole, partially at the surface 103 of the wellsite, and/or partially at a remote location, such as another well site or a remote data processing center. Sensor data and other information processed downhole may be transmitted to surface 103 to be recorded, observed, and/or further analyzed at the surface or remote site. Additionally, information recorded on information handling system 600 that may be disposed downhole may be stored until the drilling assembly 130 may be brought to surface 103. In some examples, the information handling system 600 may communicate with the drilling assembly 130 through a telemetry system (e.g., mud pulse, magnetic, acoustic, wired pipe, or combinations thereof). The information handling system 600 may transmit information to the drilling assembly 130 or BHA and may receive as well as process information recorded by drilling assembly 130 or BHA.

Generally, components of the information handling system 600 may include memory 640, one or more processor 650, and a user interface 660. Memory 640 may comprise any of a variety of electronic memory devices, such as one or more long-term storage device 642, one or more short-term storage device 644, and a non-transitory computer-readable medium (CRM) 646. Long-term memory may be structured, for example, as read only memory (ROM), which is a type of non-volatile memory for which data is not readily modified after the manufacture of the memory device. Short-term memory 644 may be structured, for example, as random access memory (RAM), which in contrast to ROM, can be read and changed. For example, short-term memory may be used to temporarily store information such as computer executable instruction code (e.g., from software) and/or data from sensors 636 for processing by a processor 650. The non-transitory CRM 646 may comprise a device or structure on which computer executable instructions, data, and other information may be stored in a non-transitory manner. The user interface 660 generally comprises one or more devices electronically connected or connectable to other components of the information handling system 600 for communicating information from or to a user (typically, a human user). The user interface 660 may include input/output (I/O) peripherals 662. Examples of peripherals for user input include a keyboard, mouse, stylus, track pad, touchscreen, smart goggles or glasses, a microphone, and biometric (e.g. fingerprint, retina, or facial recognition) sensors. Examples of peripherals that provide output for a user include a video display, a speaker, a printer or other imaging device, a tactile feedback device, and smart goggles or glasses. Some of these peripherals provide both user input and user output.

The processor 650 may include a microprocessor or other suitable circuitry for processing information, such as for estimating, receiving and processing signals from the drilling assembly 130 or other BHA components. The drilling assembly 130 or information handling system may also include one or more additional components, such as analog-to-digital converter, filter and amplifier, among others, that may be used to process the measurements of the drilling assembly 130 before they may be transmitted to surface. Alternatively, raw measurements from drilling assembly 130 may be transmitted to surface.

Any suitable technique may be used for transmitting signals from drilling assembly 130 to information handling system 600, including, but not limited to available telemetry e.g., mud pulse, magnetic, acoustic, wired pipe, or combinations thereof). While not illustrated, drilling assembly 130 may include a telemetry subassembly that may transmit telemetry data to surface. At surface, pressure transducers (not shown) may convert the pressure signal into electrical signals for a digitizer (not illustrated). The digitizer may supply a digital form of the telemetry signals to information handling system 600 via a communication link 139, which may be a wired or wireless link. The telemetry data may be analyzed and processed by information handling system 600. A communication link 640 (which may be wired or wireless, for example) may be provided that may transmit data from the drilling assembly 130 or downhole information handling subsystem to components of the information handling system 600 at surface.

The information handling system 600 described above thus represents any of a broad range of different configurations. The information handling system 600, in any of its configurations, may be used in performing all or part of the methods and controlling all or part of the systems further described herein for implementing drilling optimization, whether that entails design of rotary cutting tools, real-time control of drilling parameters, or otherwise.

The information handling system 600 or components thereof may be located at the well site of FIG. 1, particularly where dynamic control of the drilling assembly 130 is called for, and may include surface components and downhole components. Alternatively, the information handling system 600 may include components at another location, such as an implementation of design module 670 at a remote design center. In case of dynamic control of the drilling assembly, the information handling system 600 may receive data transmitted from strain gauges such that the data may be analyzed in real-time to identify downhole forces applied to the downhole drilling tool. For example, data may be analyzed in real-time (i.e., while drilling) to identify a compression value, a torsion value, and/or a bending value resulting from downhole forces applied to various locations in the drilling assembly 130 during a drilling operation. The data may be analyzed, more particularly, to identify forces above and below a selected cutting structure such as to isolate those forces from other forces experienced by the drilling assembly 130. For example, forces applied to the cutting structure of one rotary cutting tool may be isolated from forces applied to the cutting structure of another rotary cutting tool in the same drilling assembly 130.

By analyzing these downhole forces in real-time, one or more downhole drilling parameters may be modified to yield a set of optimized downhole drilling parameters. Optimized downhole drilling parameters may be used reduce the magnitude of the downhole forces applied to the downhole drilling tool during a drilling operation which may extend the lifetime of the drill bit 101 and other rotary cutting tools, and result in more efficient drilling operations. In addition, optimized downhole drilling parameters may be used to increase the magnitude of the downhole forces applied which may also result in more efficient drilling operations if it is determined that an increased magnitude of downhole force is needed.

The data collected may also be used in real time to make adjustments to the drilling assembly to modify one or more downhole drilling parameters of a particular drilling operation. Although the control of downhole drilling parameters may be overridden manually by a human, the computer-based control system at the surface or downhole may process the data and make adjustments in a way that human operator would be incapable. For example, the controller 118 may output a control signal to cause the adjustment. In one example, a control algorithm executing on the controller 118, with or without operator intermediation, may be used to initiate a modification of downhole drilling parameters during a drilling operation to optimize downhole drilling parameters without having to remove the downhole drilling tool from the wellbore.

The force data may be used by the design module 670 to adjust design representations 101A, 140A, 160A of the corresponding rotary cutting tools 101, 140, 160. These adjustments may include determining the placement of the cutting elements and/or placement of additional controlling features such as depth-of-cut control (DOCC) elements or gauge pads on design representations. Such modifications may affect a magnitude of downhole forces (i.e., increased and/or reduced magnitude) applied to the different rotary cutting tools during subsequent drilling operations due to a determined set of optimized downhole drilling parameters. The modifications may also improve efficiency splits, energy balance, and/or force distribution among multiple rotary cutting tools. Such modifications may also result in an improved overall design of the downhole drilling assembly 130.

Accordingly, the present disclosure provides drilling systems, assemblies, and methods that may be used to optimize drilling when multiple rotary cutting tools are included in the BHA. The methods/systems/compositions/tools may include any of the various features disclosed herein, including one or more of the following statements.

Statement 1. A drilling assembly, comprising: a first rotary tool comprising a first contacting structure configured for contacting a formation; a second rotary tool rotatable with the first rotary tool and comprising a second contacting structure configured for contacting the formation at a position axially spaced from the first contacting structure; at least two force sensors positioned to obtain a force applied above the second contacting structure and a force applied below the second contacting structure; and a controller in electronic communication with the force sensors configured to obtain a force differential between the force applied above the second contacting structure and the force applied below the second contacting structure.

Statement 2. The drilling assembly of Statement 1, further comprising: a third rotary tool comprising a third contacting structure configured for contacting the formation at another location axially spaced from the first and second contacting structures; and wherein the at least two force sensors are positioned to obtain a force applied above the third contacting structure and a force applied below the third contacting structure.

Statement 3. The drilling assembly of Statement 2, wherein the second rotary tool is positioned above the first rotary tool, the third rotary tool is positioned above the second rotary tool, and the at least two force sensors comprise a force sensor positioned above the third rotary tool, a force sensor positioned between the second and third rotary tools, and a force sensor positioned between the first and second rotary tools.

Statement 4. The drilling assembly of any of Statements 1 to 3, wherein the first rotary tool comprises a drill bit in which the first contacting structure comprises a first cutting structure.

Statement 5. The drilling assembly of Statement 4, wherein the second rotary tool comprises a reamer in which the second contacting structure comprises a reamer cutting structure.

Statement 6. The drilling assembly of any of Statements 1 to 5, wherein the force sensors comprise a strain gauge positioned on the body of the second tool above the second contacting structure and a strain gauge positioned on the body of the second tool below the second contacting structure.

Statement 7. A drilling optimization method, comprising: cutting a formation, including by rotating a first rotary tool having a first cutting structure in engagement with one portion of the formation together with a second rotary tool having a second contacting structure in engagement with another portion of the formation; obtaining forces above and below the second contacting structure; and adjusting one or more drilling parameter or drill bit design parameter in relation to a force differential between the forces above and below the second contacting structure.

Statement 8. The drilling optimization method of Statement 7, further comprising: using the force differential to compare a power consumed by each of the first and second rotary tools.

Statement 9. The drilling optimization method of Statement 7 or 8, further comprising: identifying an efficiency split between the first and second rotary tools based on the force differential; and adjusting the drilling parameter or drill bit design parameter to improve the efficiency split.

Statement 10. The drilling optimization method of any of Statements 7 to 9, further comprising: using a controller to control the one or more drilling parameter while drilling; and transmitting a signal in relation to the forces or the force differential to the controller while drilling; and using the controller to dynamically adjust the one or more drilling parameter in relation to the transmitted signal.

Statement 11. The drilling optimization method of any of Statements 7 to 10, further comprising: rotating a third rotary tool having a third contacting structure together with the first or second rotary tool; obtaining forces above and below the third contacting structure; and adjusting the one or more drilling parameter or the drill bit design parameter in relation to a force differential between the forces above and below the third contacting structure.

Statement 12. The drilling optimization method of Statement 11, further comprising: selectively engaging the formation with either the second or third contacting structure; and selecting different pairs of strain gauges for obtaining forces based on which of the second and third contacting structures are currently engaging the formation.

Statement 13. The drilling optimization method of any of Statements 7 to 12, wherein the first rotary tool comprises a drill bit and the second rotary tool comprises a reamer.

Statement 14. A drilling system, comprising: a drill string including a tubular conveyance;

a first rotary tool coupled to the tubular conveyance comprising a first contacting structure; a second rotary tool coupled to the tubular conveyance comprising a second contacting structure;

at least two force sensors positioned to obtain a force applied above the second contacting structure and a force applied below the second contacting structure; and a controller in electronic communication with the force sensors, the controller configured to obtain a force differential between the force applied above the second contacting structure and the force applied below the second contacting structure.

Statement 15. The drilling system of Statement 14, wherein the controller is configured to control one or both of the rotation of the first and second rotary tools and the engagement of the first or second contacting structures with the formation in relation to the force differential.

Statement 16. The drilling system of Statement 14 or 15, further comprising: a third rotary tool coupled to the conveyance comprising a third contacting structure configured for contacting the formation at another location axially spaced from the first and second contacting structures; and wherein the at least two force sensors are positioned to obtain a force applied above the third contacting structure and a force applied below the third contacting structure.

Statement 17. The drilling system of Statement 18, wherein the controller is configured to selectively engage the second and third contacting structures with the formation.

Statement 18. The drilling system of Statement 17, wherein the controller is configured to dynamically select a pair of the force sensors for obtaining forces depending on which of the second and third contacting structures are currently engaging the formation.

Statement 19. The drilling system of any of Statements 14 to 18, further comprising: a rotary tool design module configured for adjusting one or more design parameters of one or both of the first rotary tool and the second rotary tool in relation to the force differential obtained by the controller.

Statement 20. A drilling system, comprising: a drill string including a tubular conveyance;

a first rotary cutting tool coupled to the tubular conveyance comprising a first cutting structure; a second rotary cutting tool coupled to the tubular conveyance comprising a second cutting structure; at least two force sensors positioned to obtain a force applied above the second cutting structure and a force applied below the second cutting structure; and a controller in electronic communication with the force sensors, the controller configured to obtain a force differential between the force applied above the second cutting structure and the force applied below the second cutting structure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drilling assembly, comprising:

a first rotary tool comprising a first contacting structure configured for contacting a formation;

a second rotary tool above the first rotary tool and comprising a second contacting structure configured for contacting the formation at a position axially spaced from the first contacting structure;

a third rotary tool disposed above the second rotary tool and comprising a third contacting structure configured for contacting the formation at another location axially spaced from the first and second contacting structures;

a first pair of force sensors including a first force sensor disposed in a lower top sub positioned above the second contacting structure, below the third rotary tool, to obtain a force applied above the second contacting structure and a second force sensor disposed in a lower bottom sub positioned below the second contacting structure, above the first rotary tool, to obtain a force applied below the second contacting structure, and wherein each force sensor of the first pair of force sensors comprises a strain sensor incorporated into a respective strain puck, each strain puck removably received within a respective recessed area of a drilling assembly component;

a second pair of force sensors including a third force sensor disposed in an upper top sub positioned above the third contacting structure to obtain a force applied above the third contacting structure and a fourth force sensor disposed in an upper bottom sub positioned below the third contacting structure, above the second rotary tool, to obtain a force applied below the third contacting structure, and wherein each force sensor of the second pair of force sensors comprises a strain sensor incorporated into a respective strain puck; and a controller in electronic communication with the force sensors configured to obtain a first force differential, between the force applied above the second contacting structure and the force applied below the second contacting structure, and a second force differential, between the force applied above the third contacting structure and the force applied below the third contacting structure, based at least on data received from the respective force sensors.

2. The drilling assembly of claim 1, wherein the first rotary tool and the second rotary tool each comprise a drill bit or a reamer and the first contacting structure comprises a first cutting structure and the second contacting structure comprises a second cutting structure.

3. The drilling assembly of claim 1, further comprising an alignment pin and a corresponding alignment slot to receive the alignment pin to align the strain puck within the respective drilling assembly component.

4. The drilling assembly of claim 1, wherein the controller determines whether each strain sensor is calibrated in a proper alignment with compression and/or torsional forces applied to the strain gauges based on a response from the strain pucks to the compression and/or torsional forces.

5. The drilling assembly of claim 1, wherein the second pair of force sensors include a fifth force sensor positioned above the second contacting structure and a sixth force sensor positioned above the first rotary tool below the second contacting structure, and wherein each of the fifth force sensor and the sixth force sensor are located in a tool body of the second rotary tool.

6. The drilling assembly of claim 1, wherein the first rotary tool is a drill bit, the second rotary tool is a lower reamer positioned above the drill bit, the second contacting structure comprises a cutting structure defined by one or more reamer arms, wherein the second pair of force sensors includes two force sensors located in a body of the reamer, and wherein the third rotary tool is an upper ream positioned above the lower reamer.

7. The drilling assembly of claim 1, wherein the first rotary tool is a drill bit, the second rotary tool is a lower reamer positioned above the drill bit, the second contacting structure comprises a cutting structure defined by one or more reamer arms, wherein the second pair of force sensors includes two force sensors located in a sub of the reamer, and wherein the third rotary tool is an upper ream positioned above the lower reamer.

8. The drilling assembly of claim 1, wherein the first rotary tool is a drill bit, the second rotary tool is a lower reamer positioned above the drill bit, the second contacting structure comprises a cutting structure defined by one or more reamer arms, wherein the second pair of force sensors includes two force sensors located in separate subs, and wherein the third rotary tool is an upper ream positioned above the lower reamer.

9. The drilling assembly of claim 1, wherein the first force differential is obtained via data received from the first force sensor and the second force sensor, wherein the second force differential is obtained via data received from the third force sensor and the fourth force sensor.

10. The drilling assembly of claim 1, wherein the controller is configured to obtain a third force differential and a fourth force differential for analysis of downhole drilling parameters and/or design parameters, wherein the third force differential is obtained via data received from the first force sensor and the third force sensor, and wherein the fourth force differential is obtained via data received from the second force sensor and the fourth force sensor.

11. The drilling assembly of claim 1, further comprising a fifth force sensor secured to a shank of the first rotary tool, and wherein the first rotary tool is a drill bit.

12. The drilling assembly of claim 11, wherein the controller is configured to obtain a fifth force differential via data received from the fourth force sensor, positioned above the third rotary tool, and the fifth force sensor, secured to the shank, for analysis of downhole drilling parameters and/or design parameters.

13. A drilling assembly, comprising:

a first rotary tool comprising a first contacting structure configured for contacting a formation;

a second rotary tool rotatable with the first rotary tool and comprising a second contacting structure configured for contacting the formation at a position axially spaced from the first contacting structure;

at least two force sensors positioned to obtain a force applied above the second contacting structure and a force applied below the second contacting structure, each force sensor comprising a strain sensor incorporated into a respective strain puck, each strain puck removably received within a respective recessed area of a drilling assembly component; and a controller in electronic communication with the force sensors configured to obtain a force differential between the force applied above the second contacting structure and the force applied below the second contacting structure, and wherein the controller determines whether each strain sensor is calibrated in a proper alignment with compression and/or torsional forces applied to the strain gauges based on a response from the strain pucks to the compression and/or torsional forces.

14. A drilling system, comprising:

a drill string including a tubular conveyance;

a first rotary tool coupled to the tubular conveyance comprising a first contacting structure;

a second rotary tool coupled to the tubular conveyance above the first rotary tool and comprising a second contacting structure;

a third rotary tool coupled to the tubular conveyance above the second rotary tool and comprising a third contacting structure, wherein the third contacting structure is configured to contact the formation at another location axially spaced from the first and second contacting structures;

a first pair of force sensors including a first force sensor disposed in a top sub positioned above the second contacting structure, below the third rotary tool, to obtain a force applied above the second contacting structure and a second force sensor disposed in a lower bottom sub positioned above the first rotary tool, below the second contacting structure, to obtain a force applied below the second contacting structure, and wherein each force sensor of the first pair of force sensors comprises a strain sensor incorporated into a respective strain puck, each strain puck removably received within a respective recessed area of a drilling string component;

a second pair of force sensors including a third force sensor positioned to obtain a force applied above the third contacting structure and a fourth force sensor positioned to obtain a force applied below the third contacting structure, and wherein each force sensor of the second pair of force sensors comprises a strain sensor incorporated into a respective strain puck; and a controller in electronic communication with the force sensors, the controller configured to obtain a first force differential, between the force applied above the second contacting structure and the force applied below the second contacting structure, and a second force differential, between the force applied above the third contacting structure and the force applied below the third contacting structure, based at least on data received from the respective force sensors, wherein the controller is configured to selectively engage the second and third contacting structures with the formation, and wherein the controller is configured to dynamically select a pair of the force sensors for obtaining forces depending on which of the second and third contacting structures are currently engaging the formation.

15. The drilling system of claim 14, wherein the controller is configured to control one or both of the rotation of the first and second rotary tools and the engagement of the first or second contacting structures with the formation in relation to the force differential.

16. The drilling system of claim 14, further comprising:

a rotary tool design module configured for adjusting one or more design parameters of one or both of the first rotary tool and the second rotary tool in relation to the force differential obtained by the controller.

* * * * *